US012006771B2

(12) United States Patent
Bruandet

(10) Patent No.: US 12,006,771 B2
(45) Date of Patent: Jun. 11, 2024

(54) DOWN-THE-HOLE HAMMER DRILL BIT ASSEMBLY

(71) Applicants: SANDVIK MINING AND CONSTRUCTION OY, Tampere (FI); SANDVIK MINING AND CONSTRUCTION TOOLS AB, Sandviken (SE)

(72) Inventor: Olivier Bruandet, Tampere (FI)

(73) Assignees: Sandvik Mining and Construction Oy, Tamper (FI); Sandvik Mining and Construction Tools AB, Sandviken (SE)

( * ) Notice: Subject to any disclaimer, the term of this patent is extended or adjusted under 35 U.S.C. 154(b) by 184 days.

(21) Appl. No.: 17/414,787

(22) PCT Filed: Nov. 27, 2019

(86) PCT No.: PCT/EP2019/082653
§ 371 (c)(1),
(2) Date: Jun. 16, 2021

(87) PCT Pub. No.: WO2020/126359
PCT Pub. Date: Jun. 25, 2020

(65) Prior Publication Data

US 2022/0081974 A1 Mar. 17, 2022

(30) Foreign Application Priority Data

Dec. 17, 2018 (EP) ..... 18212827

(51) Int. Cl.
*E21B 4/14* (2006.01)
*E21B 10/38* (2006.01)

(52) U.S. Cl.
CPC ..... *E21B 10/38* (2013.01); *E21B 4/14* (2013.01)

(58) Field of Classification Search
CPC ..... E21B 4/14
See application file for complete search history.

(56) References Cited

U.S. PATENT DOCUMENTS 1,868,400 A * 7/1932 Stover ..... E21B 21/12 175/320
4,280,570 A * 7/1981 Walter ..... E21B 4/14 173/78

(Continued)

FOREIGN PATENT DOCUMENTS

RU 2463432 C1 10/2012
WO 03/042492 A1 5/2003

(Continued)

*Primary Examiner* — Kipp C Wallace
(74) *Attorney, Agent, or Firm* — Corinne R. Gorski

(57) ABSTRACT

A down-the-hole drilling assembly activated by fluid under pressure includes a casing having an axially rearward and forward end, a piston arranged movably inside the casing, a plurality of fluid passages for feeding and discharging pressurized fluid into and out of a working chamber for generating reciprocating movement of the piston, a drill bit at the forward end and provided with an anvil facing towards the piston for receiving impacts therefrom and an annular drive sub surrounding at least a portion of a shank and cooperating with the bit to form fluid passages extending length-wise along the shank. The drive sub has a concave arcuate groove extending circumferentially to form a chamber for collecting fluid from the hammer exhaust and redistributing a volume of the collected fluid from channels formed between complimentary splines of the drive sub and splines of the bit to flushing holes arranged in the bit.

15 Claims, 12 Drawing Sheets

(56) References Cited

U.S. PATENT DOCUMENTS 4,705,118 A * 11/1987 Ennis ..... E21B 6/06 175/65
5,407,021 A * 4/1995 Kane ..... E21B 10/38 175/418
5,839,525 A * 11/1998 Hoffmaster ..... E21B 7/064 76/108.4
6,702,045 B1 3/2004 Elsby
7,581,602 B2 * 9/2009 Lorger ..... E21B 4/14 175/418
8,915,314 B2 * 12/2014 Lyon ..... E21B 4/14 175/135
9,938,768 B2 * 4/2018 Carlsson ..... E21B 17/22
10,662,715 B2 * 5/2020 Bruandet ..... E21B 10/36
2002/0066599 A1 * 6/2002 Gien ..... E21B 4/14 175/405
2004/0140131 A1 * 7/2004 Susman ..... E21B 31/113 175/321
2006/0283637 A1 * 12/2006 Viel ..... E21B 10/02 175/403
2010/0243333 A1 * 9/2010 Purcell ..... E21B 4/14 175/414
2011/0209919 A1 * 9/2011 Aros ..... E21B 4/14 175/296
2013/0008722 A1 1/2013 Gilbert et al.
2014/0360783 A1 * 12/2014 Lyon ..... E21B 4/14 175/57
2016/0340983 A1 * 11/2016 Bruandet ..... E21B 4/14
2020/0370373 A1 * 11/2020 Aros ..... E21B 10/38
2021/0062586 A1 * 3/2021 Keskiniva ..... E21B 6/04

FOREIGN PATENT DOCUMENTS

WO WO-2017148978 A1 * 9/2017 ..... E21B 10/36
WO 2018107304 A1 6/2018

* cited by examiner

SECTION D-D

SECTION E-E

SECTION D-D

SECTION E-E

SECTION E-E

SECTION F-F

DOWN-THE-HOLE HAMMER DRILL BIT ASSEMBLY

RELATED APPLICATION DATA

This application is a § 371 National Stage Application of PCT International Application No. PCT/EP2019/082653 filed Nov. 27, 2019 claiming priority to EP 18212827.2 filed Dec. 17, 2018.

TECHNICAL FIELD

The present disclosure relates to a percussive drill bit assembly. More particularly, the disclosure relates to the flow distribution in the down-the-hole hammer drill bit assembly.

BACKGROUND

Down-the-hole (DTH) percussive drilling involves a method combining percussions and rotations. A pressurized fluid is supplied via a drilling tube to a drill bit located at the bottom of a bore hole. This fluid acts to both drive the hammer drilling action and to flush rearwardly the broken debris resulting from the cutting action. Typically, a DTH percussive drilling assembly or a hammer drill bit assembly comprises a casing extending between a top sub and a drill bit that is releasably coupled to a drive sub. A reciprocating fluid driven impact device or piston is arranged inside the casing. At both ends of the piston are working chambers, namely a top working chamber and a bottom working chamber into which fluid is discharged according to the work cycle of the piston. Conventional DTH drilling machines also comprise a drill bit assembly made up of a shank, a bit head which further comprises buttons on the surface facing the drill hole, and flushing holes to allow broken debris to be removed immediately so that the buttons hit the fresh solid rock surface with each impact.

Presently used drill bit assemblies suffer from the drawback that there is not enough volume available in the drill bit assembly for air, especially in the assemblies having bits in which the internal bore at the center of the bit is closed at the front end of the shank and open at the rear end towards the piston. In such bits, usually the number of splines is more than the number of flushing holes, and since there is a change in the flow paths of the air when it travels from the splines to the flushing holes, some space is needed for the air to accommodate this change. When this volume for air is not provided, the efficiency of drilling gets affected.

To address this problem, it has been observed that in some drill bits, this volume is provided by the presence of a groove in the shank of the drill bit. The disadvantage of this construction is that the bit shank integrity was compromised which results in a shorter life span of the drill bit. The frequent replacement of the drill bit incurs high costs for maintenance and also results in significant down time for the drilling machine.

Another approach to address this problem has been observed in some reverse circulation (RC) hammers which comprise of a shroud-like structure or a sleeve around the drive sub to create the volume for collecting the flow from the hammer. Examples of such assemblies are described in patent documents U.S. Pat. No. 6,702,045 and EP1454031. The problem with this type of construction is that the flow is usually between the outer surface of the drive sub and the inner surface of the shroud, and the flow does not connect the flushing holes in the drill bit. Also, this kind of a solution turns out to be more expensive and complicated to construct as it involves an additional component which needs to be assembled in to the hammer. Since the DTH drilling machine is located inside the drill hole, the structure of the machine needs to be compact.

Accordingly, there exists a need for a robust, compact and structurally uncomplicated drill bit assembly which improves the flow distribution in the drill bit assembly without compromising the integrity of the drill bit.

BRIEF SUMMARY OF THE DISCLOSURE

The aim of the present disclosure is to overcome or at least reduce the above-mentioned problems.

It is an objective of the present disclosure to provide a robust and structurally uncomplicated rock drill bit assembly with good flow distribution especially through the drill bit. It is a further objective to achieve good flow distribution in the drill bit assembly by providing volume for the pressurized fluid or air which flows downstream during the drilling operation without the use of additional components. It is yet another objective to preserve the integrity of the drill bit during the drilling operations so that fewer bit replacements for the hammer are required.

The objectives are achieved by providing a rock drill bit assembly which allows for the volume or space for the upstream flow of pressurized fluid from the hammer exhaust while connecting the splines with the flushing holes.

According to the first embodiment of the present disclosure, there is provided a down-the-hole hammer assembly activated by fluid under pressure, which comprises an elongated casing having a front end or an axially forward end and a rear end or an axially rearward end, a fluid-powered piston arranged movably inside the casing, a top working chamber at an axially rearward side or top side of the piston, a bottom working chamber at an axially forward side or bottom side of the piston, a plurality of fluid passages for feeding and discharging pressurized fluid into and out of the working chambers for generating reciprocating movement for the piston, a drill bit connectable to the front end or the axially forward end of the casing and provided with an anvil facing towards the piston for receiving the impacts of the piston, and an annular drive sub surrounding at least a portion of the shank and cooperating with the drill bit to form fluid passages extending length-wise along the shank, wherein the drive sub comprises a concave arcuate groove extending circumferentially through the drive sub forming a chamber for collecting the fluid from the exhaust flow and redistributing the volume of the collected fluid to the flushing holes arranged in the drill bit. The arcuate groove is located above the feed force transmission point as the distance to the exhaust, i.e. the distance of the flushing holes to atmosphere, is greater and it will allow for the flow to be more evenly distributed among the flushing holes and less turbulent inside the flushing holes, resulting in the more predictable flushing which is easier to optimize. If the groove is positioned below the feed force transmission point a weak spot would be created that will be subject to tensile stress which leads to fatigue failures. During drilling the feed force transmission area is subject to impact and vibrations from the bit. As the piston hits to the bit striking face, the bit moves forward inside the rock, breaks the rock and then bounces back toward the hammer and is stopped by the feed force transmission area. Therefore, it is important that the groove is positioned above the feed force transmission point to avoid the formation of tensile stress. The arcuate groove has a minimum volume dimension of:

Minimum flow volume≥2×min(Flow area from hammer; Flushing holes area)

Meaning that the volume should be greater than 2 times either the flow area from hammer (the area between the splines) or the flushing holes area, depending which is the smallest.

During the drilling operation, the exhaust flow coming from the hammer is collected in a chamber formed by the arcuate concave groove in the drive sub. This volume of pressurized fluid is connected to the flushing holes arranged in the drill bit which permits even redistribution of the flow from the hammer among the flushing holes without having to create flow passages on the shank of the drill bit.

Preferably, the chamber in the drive sub creates a fluid passage between the outer surface of the drill bit and the inner surface of the drive sub for collecting the fluid from the exhaust flow. Preferably, the outer diameter of the drive sub is smaller than the outer diameter of the bit head. The drill bit and the drive sub are configured to be arranged such that the drive sub is positionable to axially overlap and to radially encompass at least a part of the shank region of the drill bit. The angle of the bottom edge of the drive sub corresponds to the angle of the bit head-shank transition area. This is advantageous because it ensures accurate positioning of the drill bit relative to the drive sub, and also provides an increased contact area between the bit and the sub which in turn reduces the surface pressure or stress on the bit thereby increasing the lifespan of the bit.

Preferably, the drive sub comprises on its top edge, a plurality of peripheral projections which create slots extending through the thickness of the wall of the drive sub. These slots allow passage of the pressurized fluid from the hammer exhaust into the drive sub. An advantage of having these slots is that the bit retaining ring does not need the traditional scallops to allow the fluid to pass, thus making the bit retaining ring stronger and allowing it to have more retention area. Another advantage of having these slots is that the pressurized fluid is more evenly distributed in the space between the splines of the bit and the splines of the drive sub providing good lubrication between the splines.

One of the advantages of this embodiment of the present disclosure is that there is no need for any additional component like a sleeve or shroud to form the chamber for accommodating volume of the pressurized fluid from the exhaust flow. This makes the construction of the apparatus substantially simplified. Another advantage of this feature is that there is no need to create flow passages on the shank. This is useful in preserving the integrity and strength of the drill bit and increasing its life-span.

Optionally, a radially inward facing part of the drive sub comprises a plurality of radially extending retaining formations and a radially outward facing part of the shank of the rock drill bit comprises a plurality of radially extending retaining formations such that the formations of the drive sub are configured to inter-engage cooperatively and releasably with the formations of the shank of the rock drill bit. Preferably, the retaining formations on both the shank of the bit and the drive sub, are in the form of axially and radially extending splines. Such an arrangement enables the transfer of torque from the drive sub to the rock drill bit. The advantage of such an arrangement is that the bit can be easily and readily removed and replaced when worn, which is especially useful when the service lifetime for the bit is different from that of the drive sub. It is an advantage to have these complimentary splines on the shank and the sub to allow easy and efficient transfer of rotational drive from the drive sub to the rock drill bit.

Preferably, the hammer described in the present disclosure is pneumatic and the fluid under pressure is air.

According to the second embodiment of the present disclosure, the drilling assembly is provided with a rock drill bit positioned at the cutting end or the axially forward end of the hammer, and comprising of a head, an elongated shank connected to the head at the front end or the axially forward end of the shank, a head-shank transition area where the head connects to the shank, an anvil at the axially rearward end of the shank for receiving the impact of the piston, a plurality of buttons provided at the front face of the head configured to engage the material to be crushed in the intended direction of drilling and a plurality of flushing passages for the fluid extending through the head and having at least one opening at the front face of the head. The rock drill bit solves the problem of increased stress on the bit head-shank transition area by the characterizing feature that the angle formed between the head and the shank at the head-shank transition area is greater than 100 degrees. The advantage of having an angle greater than 100 degrees in the bit head-shank transition area is that this kind of construction greatly reduces the stress encountered by the bit head-shank transition area during the drilling operation. Reduced stress preserves the strength of the rock drill bit ensuring that the rock drill bit has a longer than average lifespan. This reduces the maintenance cost for the drilling assembly as the rock drill bit does not have to be replaced frequently. Further, the down-time of the equipment is also reduced as now the bit is replaced fewer number of times.

Another advantage of this unique feature of the angle between the bit head and shank transition is that it forms a conical surface in the bit to transmit the feed force.

Advantageously, this conical surface guides precisely the drill bit during operation and increase the contact surface for feed force transmission thus reducing the surface pressure (stress) in the bit head-shank transition area.

Preferably, the angle between the bit head and shank in the rock drill bit should be between 100 and 160 degrees. More preferably, the angle between the bit head and shank should be between 110 and 130 degrees.

According to the third embodiment of the present disclosure, the internal bore at the center of the bit is closed at the front end or the axially forward end of the shank and open at the rear end or the axially rearward end of the shank which is towards the piston. The internal blind bore in this rock drill bit is configured to constitute a part of the bottom working chamber of the hammer. Since the center of the bit is not used for flushing as in conventional drill bits, this volume can be used as the bottom working chamber for the hammer. An advantage of this kind of construction is that it would make the hammer more compact.

Optionally, the feature of the angle between bit head and shank being greater than 100 degrees, would improve the strength of the drill bits, which is especially beneficial for bits in which the internal bore at the center is closed at the front end of the shank and open at the rear end towards the piston. These blind-bore bits encounter immense stress in the bit head-shank transition area because of the presence of flushing holes in that area which create fluid passages for the upstream flow from the hammer. Having an angle greater than 100 degrees between the bit head and the shank in such blind-bore bits substantially improves the strength of the bit.

According to the fourth embodiment of the disclosure, in the rock drill bit, the bit head-shank transition area is provided with a recess near the opening for the flushing holes, which is preferably in the form of an inward curvature or an arcuate concave groove. This structural feature provides the advantage of reduced stress in the bit head-shank transition area in the rock drill bit. Specifically, this structural feature improves the strength and lifespan of those rock drill bits in which the internal central bore is closed at the axially forward end of the shank and open at the axially rearward end of the shank which is towards the piston. Optionally, the recess can be in the shape of square, circular, elliptical, rectangular or triangular pockets.

Preferably, the bit head and the shank in the rock drill bit are constructed as a single integrated unit. However, the features explained above are also adapted to provide good drilling results if the rock drill bit constitutes of multiple components comprising the bit head and the shank assembled together.

Optionally, the rock drill bit described in the present disclosure is adapted to work with the reverse circulation percussive hammers. The reverse circulation drill bits used in this application may have flushing holes positioned between the center and the periphery of the bit head. Alternatively, the flushing holes may be positioned radially at the periphery of the bit head. The reverse circulation hammer may or may not have a shroud around the bit head. According to one of the embodiments, the reverse circulation drill bit does not have the shroud around the bit head, and the outer surface of the bit head mates with the hole wall. Advantageously, the removal of one component (the shroud) from the traditional construction makes the hammer more compact.

BRIEF DESCRIPTION OF FIGURES

Some embodiments of the invention will be explained in greater detail with reference to the accompanying drawings in which.

DETAILED DESCRIPTION OF FIGURES

The present disclosure will now be described with reference to the accompanying embodiments which do not limit the scope and ambit of the disclosure. The description provided is purely by way of example and illustration.

Figure 1:
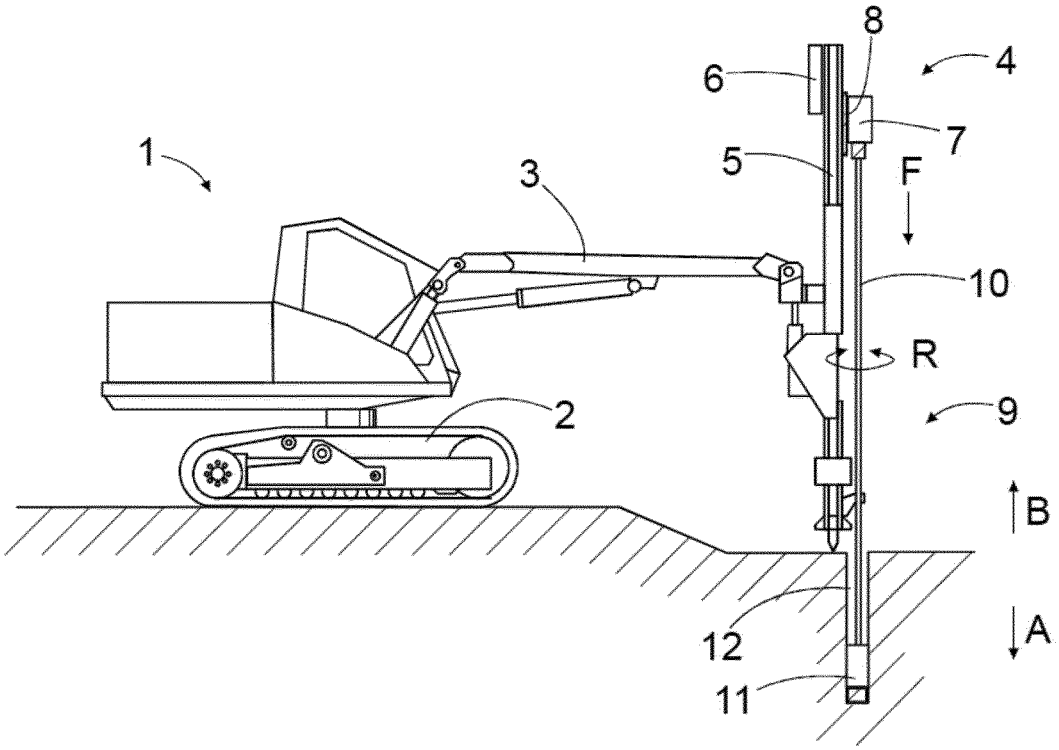
FIG. 1 shows schematically a rock drilling rig provided with a DTH rock drilling machine.

FIG. 1 shows a rock drilling rig 1 that comprises a movable carrier 2 provided with a drilling boom 3. The boom 3 is provided with a rock drilling unit 4 comprising a feed beam 5, a feed device 6 and a rotation unit 7. The rotation unit 7 may comprise a gear system and one or more rotating motors. The rotation unit 7 may be supported to a carriage 8 with which it is movably supported to the feed beam 5. The rotation unit 7 may be provided with drilling equipment 9 which may comprise one or more drilling tubes 10 connected to each other, and a DTH drilling machine 11 at an outermost end of the drilling equipment 9. The DTH drilling machine or hammer 11 is located in the drilled bore hole 12 during the drilling.

Figure 2:
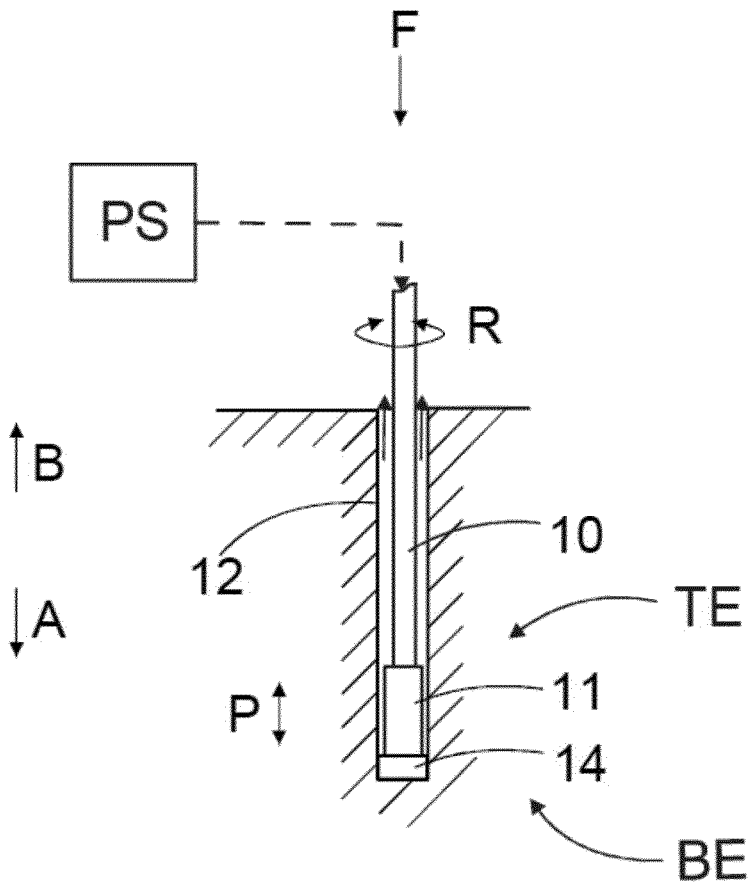
FIG. 2 shows schematically a DTH drilling machine at the bottom of a drill hole.
Figure 4:
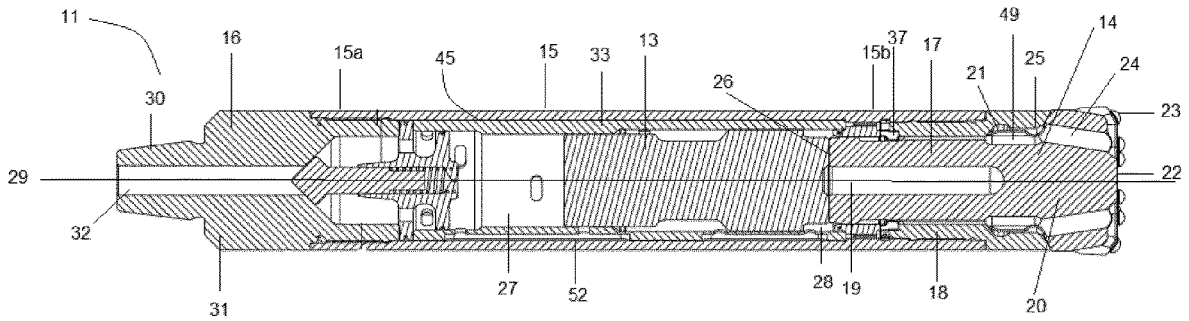
FIG. 4 shows a vertical cross section of a hammer according to a specific implementation of the present disclosure.

FIG. 2 shows that the hammer 11 comprises an impact device or a piston 13 (shown in FIG. 4). The piston 13 is at the opposite end of the drilling equipment 9 in relation to the rotation unit 7. During drilling, a drill bit 14 is connected directly to the piston 13, whereby percussions P generated by the piston 13 are transmitted to the drill bit 14. The drilling equipment 9 is rotating around its longitudinal axis in direction R by means of the rotation unit 7 shown in FIG. 1 and, at the same, the rotation unit 7 and the drilling equipment 9 connected to it are fed with feed force F in the drilling direction A by means of the feed device 6. Then, the drill bit 14 breaks rock due to the effect of the rotation R, the feed force F and the percussion P. Pressurized fluid is fed from a pressure source PS to the drilling machine 11 through the drilling tubes 10. The pressurized fluid may be compressed air and the pressure source PS may be a compressor. The pressurized fluid is directed to influence to working surfaces of the piston 13 and to cause the piston 13 to move in a reciprocating manner and to strike against impact surface or anvil 26 of the drill bit 14. After being utilized in working cycle of the hammer 11, pressurized air is allowed to discharge form the hammer 11 and to thereby provide flushing for the drill bit 14. Further, the discharged air pushes drilled rock material out of the drill hole 12 in an annular space between the drill hole and the drilling equipment 9. Alternatively, the drilling cuttings are removed from a drilling face inside a central inner tube passing through the impact device. This method is called reverse circulation drilling. FIG. 2 indicates by an arrow TE an upper end or top end or the axially rearward of the hammer 11 and by an arrow BE a lower end or bottom end or the axially forward end of the hammer 11.

Figure 3:
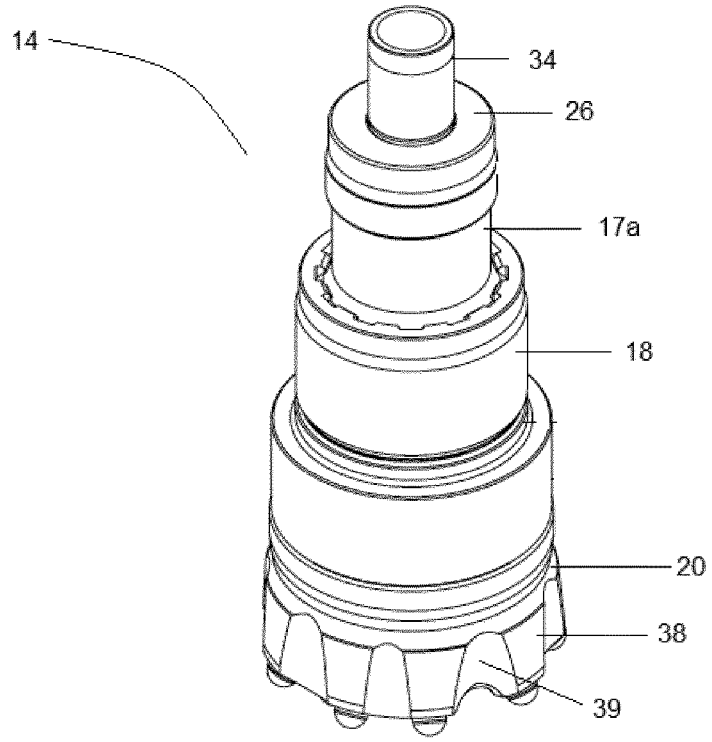
FIG. 3 shows a perspective view of a known rock drill bit assembly with the drive sub covering a portion of the shank.

Referring to FIG. 3, a standard drill bit 14 can be seen. Drill bit head 20 comprises of a plurality of peripheral sludge grooves 39 which are recessed radially into an annular outer wall 38 of the bit head 20. Foot valve 34 can also be observed in the FIG. 3. Foot valve is used to control the air cycle of the hammer and, the venting and closing of the bottom working chamber 28.

Referring to FIG. 4, the vertical cross-section of the hammer 11 is shown, 29 being the longitudinal axis of the hammer 11. The hammer 11 comprises a casing 15 with an axially rearward end 15*a* and an axially forward end 15*b*. Within the casing 15 is mounted a conventional free piston 13 which is arranged to be moved in a reciprocating manner during its work cycle. A top sub 16 is at least partially accommodated within the rearward end 15*a* of the casing 15. Also mounted, is a connection piece 31 by means of which the hammer 11 is connected to the drilling tube 10. The connection piece 31 may comprise threaded connecting surface 30. In connection with the connection piece 31, is an inlet port 32 for feeding pressurized fluid to the piston. The inlet port 32 may comprise valves which allow the feeding of the fluid towards the piston but prevent the flow of the fluid in the opposite direction. At the axially rearward end of the piston is a top working chamber 27 and at the axially forward end of the piston is the bottom working chamber 28. A distributor cylinder 33 extends axially within the casing 15 against the inner face 45 of the casing 15 and defines an axially extending internal chamber which includes the top working chamber 27 and the bottom working chamber 28. Piston 13 is capable of reciprocating axially to shuttle within the chamber regions 27 and 28. Also visible in the FIG. 4, are fluid passages 52 for feeding and discharging pressurized fluid into and out of the working chambers 27, 28 for generating reciprocating movement for the piston 13. The drill bit 14 is positioned at the axially forward end of the hammer 11. The bit 14 comprises a rearward face 26 which represents the anvil on which the piston 13 impacts to cause the bit 14 to move forward. It also comprises a bit head 20 and a shank 17 with a central internal bore 19 which is closed at the forward end. Flushing holes 24 extend axially rearward from the forward face 22 of the bit. Inserts or buttons 23 are provided on the forward face 22 of the bit for cutting the drilling surface. A drive sub 18 surrounds at least a part of the shank 17 extending axially from the rearward face of the bit 26 to the bit head-shank transition area. Bit retaining ring 37 is also visible in the FIG. 4.

Figure 5A:
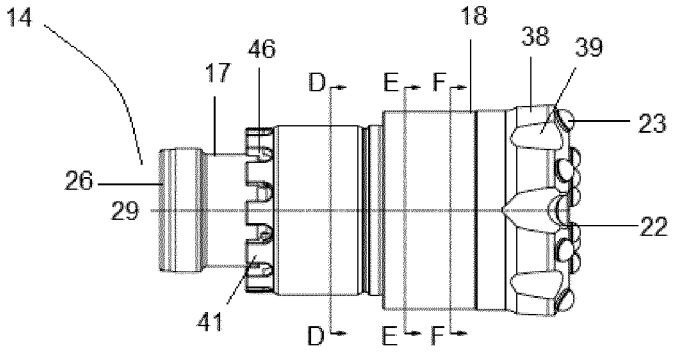
FIG. 5*a* shows a side view of the drill bit of FIG. 4.

Referring to FIG. 5*a*, the projected view of the drill bit 14 surrounded by the drive sub 18 is shown. Cross-sections have been taken from three different points on the drill bit 14, one being near the top end or the axially rearward end of the drive sub 18 (D-D), one near the bottom end or the axially forward end of the drive sub 18 (F-F) and one in the middle of the drive sub 18 (E-E). Cross section D-D is shown in FIG. 5*c* where the splines 42 on the bit can be seen engaging with the corresponding splines 43 on the drive sub 18 forming channels 48. The exhaust fluid from the hammer flows through the channels 48 which are formed between the splines 42 and 43.

Figure 5B:
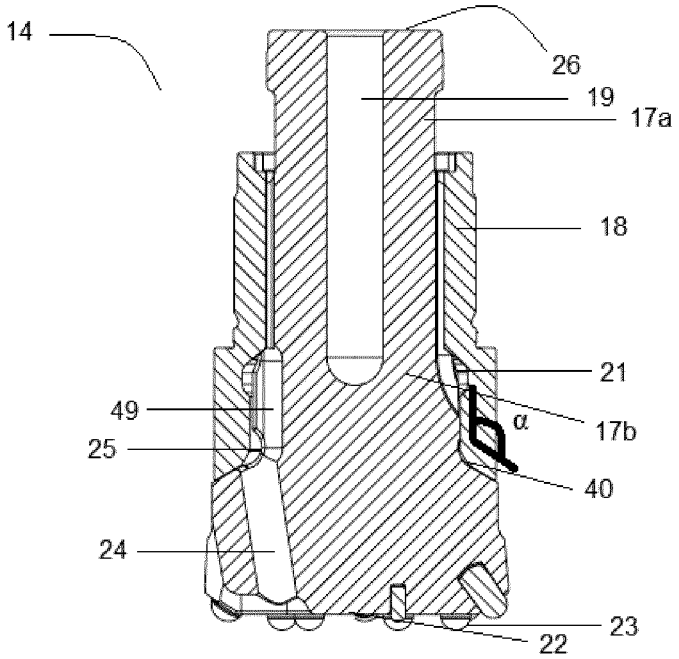
FIG. 5*b* shows a vertical cross sectional view of the drill bit with drive sub covering the shank portion of FIG. 5*a*.
Figure 5C:
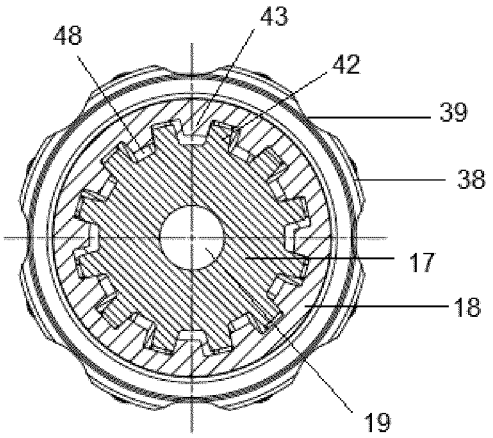
FIGS. 5*c*, 5*d* and 5*e* show the cross sectional views taken from different cross sections of FIG. 5*a*, D-D, E-E, F-F, respectively.
Figure 5D:
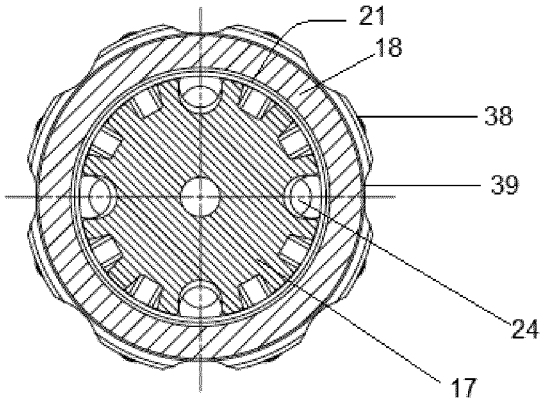
Figure 5E:
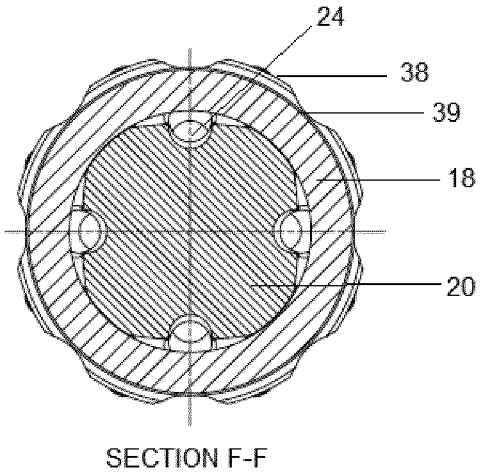

Referring to FIG. 5*d*, cross section E-E shows the chamber 21 which is formed due to the arcuate concave groove in the drive sub 18. The upstream exhaust from the hammer flows from the splines 42, 43 and then enters the flushing holes 24. But since the number of holes and splines is different, a volume of the fluid gets accumulated in the chamber 21 before making the transition in the numbers of the fluid paths, from splines to the holes. Cross section F-F in FIG. 5*e* shows the bit head 20 and the flushing holes 24 from which the exhaust fluid enters the bit 14.

As is clear from FIG. 5*b*, the drive sub 18 extends axially from the narrow upper end 17*a* of the shank to the bit head-shank transition area 40. The arcuate recess in the form of a concave groove in the drive sub 18 forms a chamber 21 which accumulates volume of pressurized fluid coming from the exhaust of the hammer 11 during the drilling operation. The drill bit 14 has an obtuse angle in the bit head-shank transition area 40, shown as a on FIG. 5*b*. The angle is preferably between 100 and 160 degrees. More preferably, the angle may be between 110 and 130 degrees. Recess 25 in the bit head-shank transition area 40 near the flushing holes 24, is provided to reduce the stress generated in the bit head-shank transition area 40 during the drilling operation.

Figure 6A:
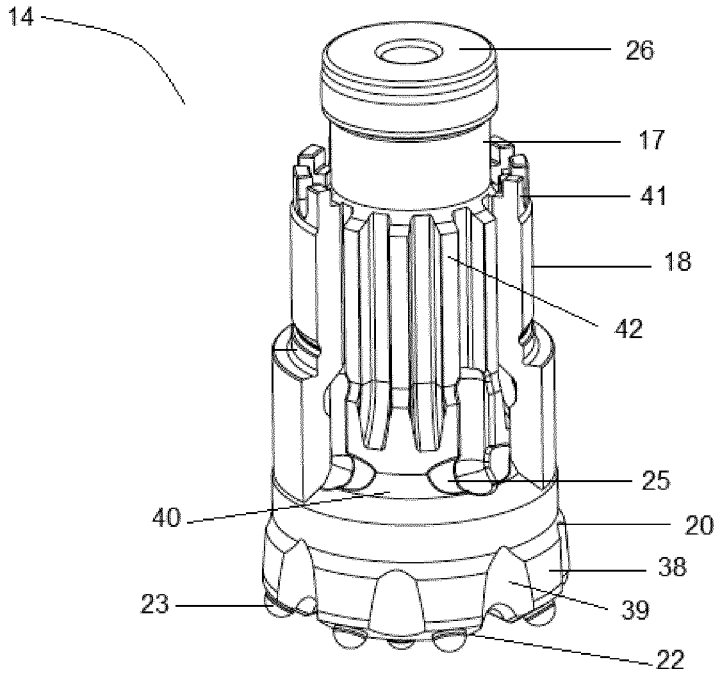
FIG. 6*a* is a partial cut-away perspective view of the drill bit assembly of FIG. 4.
Figure 6B:
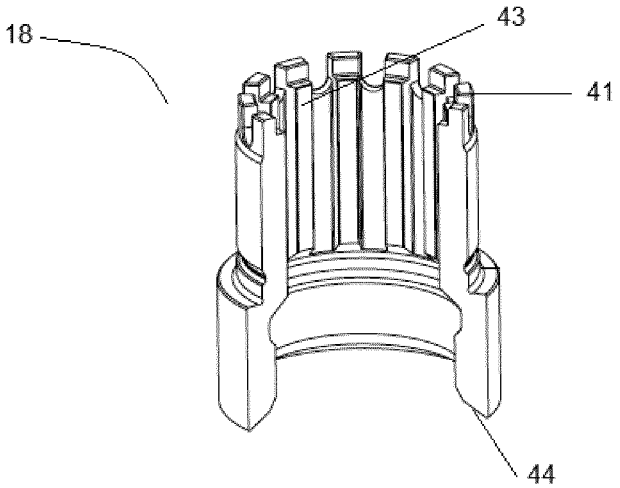
FIG. 6*b* is a cut-away view of the drive sub highlighting the concave groove.

Referring to FIG. 6*a*, a partial cut-away view of the drive sub 18 surrounding the shank 17 of the drill bit 14 can be observed. FIGS. 6*b* shows the partially cut-away drive sub 18 alone without the drill bit 14. Drive sub 18 is provided with a plurality of peripheral projections 41 which create radially spaced slots 46 which enable the upstream flow of the pressurized fluid from the hammer exhaust to be evenly distributed between the bit splines 42 and the splines 43 on the drive sub while maintaining lubrication between the splines 42 and 43. The slots 46 extend through the radial thickness or the wall of the drive sub 18. The drill bit 14 is provided with concave arcuate recesses 25 in the bit head-shank transition area 40 to help with reducing the stress that is generated in this area during the drilling operation.

Complimentary splines 42 (on the drill bit 14) and 43 (on the drive sub 18) are also shown in the FIG. 6*a*. Referring to FIG. 6*b*, the bottom edge 44 of the drive sub 18 has an angle corresponding to the bit head-shank transition angle of the drill bit 14 such that the bottom edge 44 of the drive sub 18 is mated against the bit head transition area 40. This angled construction of the bottom edge 44 of the drive sub 18 provides a conical surface which facilitates accurate positioning of the drill bit 14 relating to the drive sub 18 and an increased contact area which in turn reduces the surface pressure or stress in the bit head-shank transition area 40.

Figure 7A:
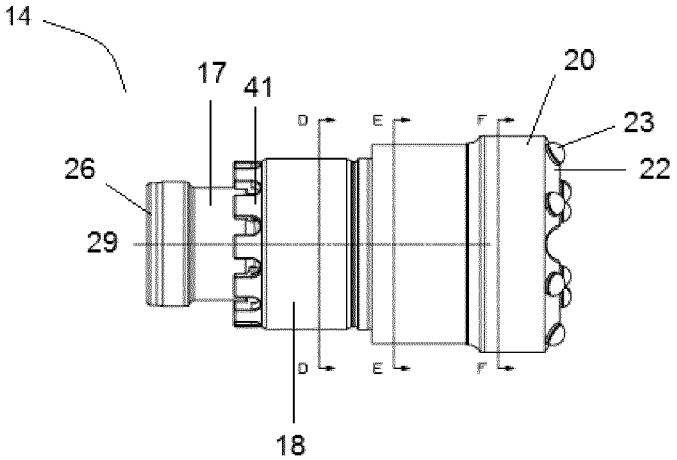
FIG. 7*a* is a perspective view of an example of an RC bit assembly according to a further specific implementation.
Figure 7B:
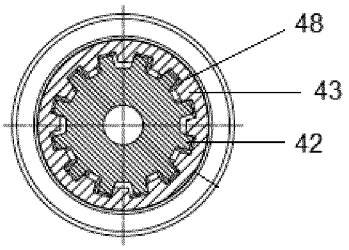
FIGS. 7*b*, 7*c* and 7*d* show the cross sectional views taken from different cross sections of FIG. 7*a*, D-D, E-E, F-F, respectively.
Figure 7C:
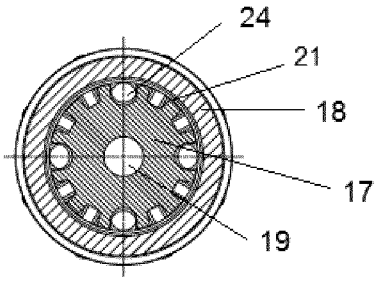
Figure 7D:
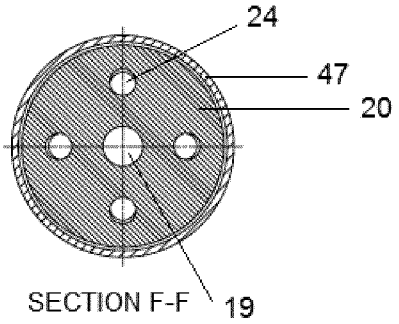

The different aspects of the disclosure are also applicable to reverse circulation hammers and the bits used therein. Referring to FIG. 7*a*, a projected view of a reverse circulation drill bit is shown. Cross sections at three points in the drill bit 14 have been depicted in FIGS. 7*b*, 7*c* and 7*d*. The bit shown in FIGS. 7*a*-7*e* is provided with a central internal bore 19 through which the pressurized fluid along with cuttings or drilled material flows upstream. Also provided in the RC bit 14 are flushing holes 24, drive sub 18 with concave groove forming chamber 21, shank 17 and bit head 20 with buttons 23 on the forward face 22. Referring to FIG. 7*b*, the drive sub 18 is seen surrounding the shank 17 of the bit 14 in the cross-section D-D. The flushing holes 24 and the splines 42 are visible in cross section E-E in FIG. 7*c*. The chamber 21 collects the upstream exhaust of pressurized fluid from channels 48 formed between the splines 42 and 43 and redistributes it to the flushing holes 24. Cross section F-F taken from the bit head 20 shows the passageways from flushing holes 24 and the central internal bore 19 as seen in FIG. 7*d*.

Figure 7E:
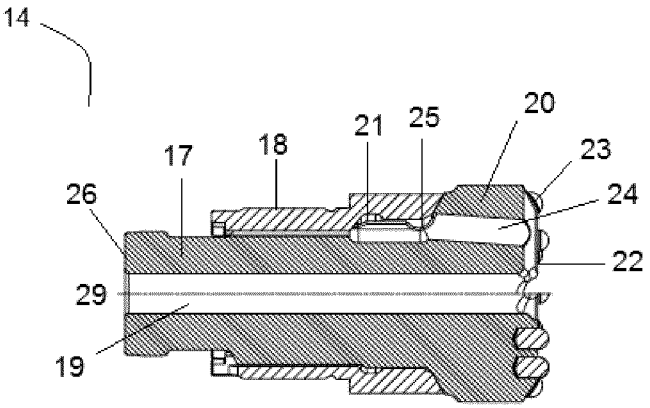
FIG. 7*e* is a vertical cross-section of the RC bit assembly of FIG. 7*a;*
Figure 8A:
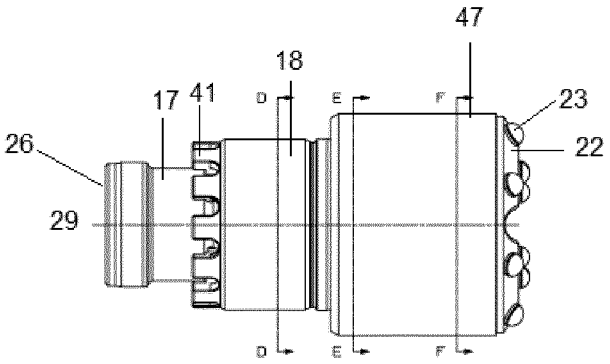
FIG. 8*a* is a perspective view of an example of RC bit assembly according to a further specific implementation.
Figure 8B:
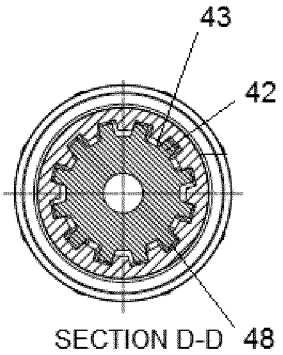
FIGS. 8*b*, 8*c* and 8*d* show the cross sectional views taken from different cross sections of FIG. 8*a*, D-D, E-E, F-F, respectively.
Figure 8C:
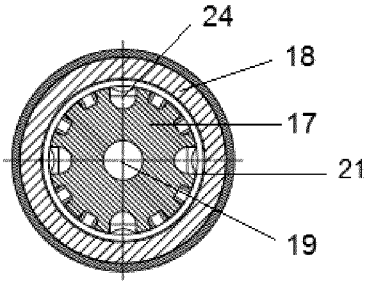
Figure 8D:
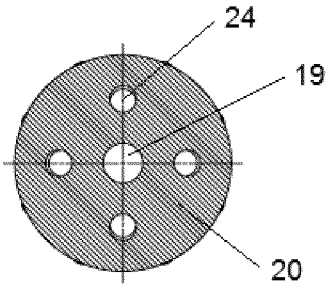
Figure 8E:
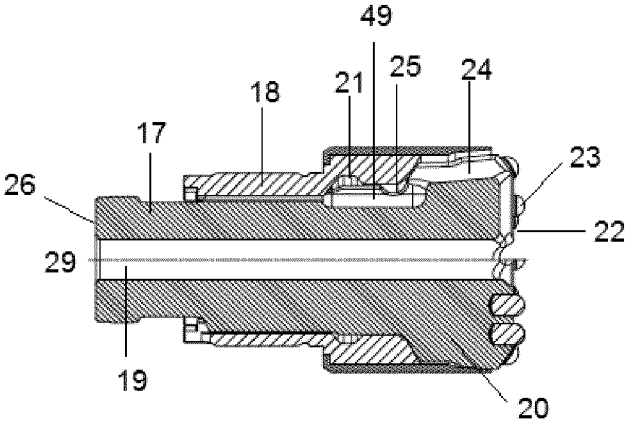
FIG. 8*e* is a vertical cross-section of the RC bit assembly of FIG. 8*a*.

Referring to FIG. 7*e*, a vertical cross-section of the drill bit 14 used for reverse circulation hammer is shown. The bit 14 has a longitudinal axis 29, bit head 20, shank 17, buttons 23, forward face 22 and rearward face 26. Also provided in the bit 14, is a drive sub 18 surrounding a portion of the shank 17 and extending up to the bit head-shank transition area 40. An internal central bore 19 extends through the length of the bit 14 and is used for the upward passage of the pressurized fluid and the drilled material during the drilling operation. The bit head 20 is provided with a plurality of flushing holes 24 which are positioned between the centre and the periphery of the bit head 20.

Similarly, FIGS. 8*a*-8*e* depict a reverse circulation drill bit 14 in which the flushing holes 24 are positioned at the periphery of the bit head 20.

The invention claimed is:

1. A down-the-hole drilling assembly activated by fluid under pressure, said assembly comprising:

a hammer including an elongate casing having an axially rearward end and an axially forward end;

a fluid-powered piston arranged movably inside the casing;

a top working chamber at a top side of the piston;

a bottom working chamber at a bottom side of the piston;

a plurality of fluid passages for feeding and discharging pressurized fluid into and out of the working chambers for generating reciprocating movement for the piston;

a drill bit connectable to the axially forward end of the casing and provided with an anvil facing towards the piston for receiving impacts of the piston; and an annular drive sub surrounding at least a portion of an elongate shank and cooperating with the drill bit to form fluid passages extending length-wise along the shank, wherein the drive sub includes a concave arcuate groove extending circumferentially in the drive sub forming a chamber, the chamber being connected to channels arranged for collecting fluid from a hammer exhaust flow and redistributing a volume of the collected fluid from the channels to flushing holes arranged in the drill bit, the channels being formed between a plurality of splines of the drive sub and a plurality of splines of the drill bit, wherein the chamber is located on the top side of a head-shank transition area where feed force transmission occurs, wherein the concave arcuate groove forming the chamber has a minimum volume dimension which is constrained by the lesser of a cumulative flow area between the splines or the flow area of the flushing holes in order to permit even redistribution of flow from the hammer.

2. The down-the-hole drilling assembly claimed in claim 1, wherein the fluid passage are created between an outer surface of the drill bit and an inner surface of the drive sub for collecting the fluid from the exhaust flow.

3. The down-the-hole drilling assembly claimed in claim 1, wherein the drill bit and the drive sub are configured to be arranged such that the drive sub is positionable to axially overlap and to radially encompass at least a part of the shank of the drill bit.

4. The down-the-hole drilling assembly claimed in claim 1, wherein the drive sub plurality of splines are arranged for engaging with the plurality of complimentary splines on the shank of the drill bit for transferring the torque from the sub to the drill bit.

5. The down-the-hole drilling assembly claimed in claim 1, wherein the drill bit includes a bit head with the elongated shank connected to the head and a head-shank transition area, wherein the head connects to the shank in such a way that an angle formed between the head and the shank at the head-shank transition area is greater than 100 degrees.

6. The down-the-hole drilling assembly claimed in claim 5, wherein the angle formed between the head and the shank at the head-shank transition area of the drill bit is greater than 100 degrees and smaller than 160 degrees.

7. The down-the-hole drilling assembly claimed in claim 5, wherein the angle formed between the head and the shank at the head-shank transition area of the drill bit is greater than 110 degrees and smaller than 130 degrees.

8. The down-the-hole drilling assembly claimed in claim 1, wherein an outer surface of the head-shank transition area of the rock drill bit has a recess, which is positioned proximally to openings of the flushing holes.

9. The down-the-hole drilling assembly claimed in claim 1, wherein the bit head and the shank of the bit are constructed as a single integrated unit.

10. The down-the-hole drilling assembly claimed in claim 1, wherein an internal bore at a center of the bit is closed at the forward end of the shank and open at the rear end of the shank towards the piston and wherein the internal bore is configured to constitute a part of the bottom working chamber of the assembly.

11. The down-the-hole drilling assembly claimed in claim 1, wherein the drive sub includes a plurality of peripheral projections on its top edge creating radially spaced slots, which extend through a radial thickness of a wall of the drive sub.

12. The down-the-hole drilling assembly claimed in claim 1, wherein the drive sub includes a bottom edge having an angle corresponding to the angle of the bit head transition area, said bottom edge being positionable over the bit head transition area.

13. The down-the-hole drilling assembly claimed in claim 1, wherein the drill bit is a reverse-circulation drill bit having the drilling cuttings flowing upstream and passing through a center of the drill bit, said drill bit including the shank attached to the head of the bit, said shank being at least partially surrounded by the annular drive sub having the arcuate concave groove extending circumferentially in the drive sub, which creates the chamber for accumulating the volume from the hammer exhaust.

14. The down-the-hole drilling assembly claimed in claim 13, wherein the reverse circulation drill bit includes a bit head having the plurality of flushing holes positioned between the center and a periphery of the bit head extending from the forward face of the bit to the bit head-shank transition area creating passages for the fluid from the exhaust of the hammer.

15. The down-the-hole drilling assembly claimed in claim 13, wherein the reverse circulation drill bit includes a bit head, wherein the flushing holes comprise a plurality of radially spaced flushing holes positioned at a periphery of the bit head extending from the forward face of the bit to the bit head-shank transition area and creating passages for the fluid from the exhaust of the hammer.

* * * * *